United States Patent [19]

Huet

[11] Patent Number: 4,945,814

[45] Date of Patent: Aug. 7, 1990

[54] MOLDED COMPOSITE ARMOR

[75] Inventor: Roger Huet, Grenoble, France

[73] Assignee: Aluminum Company of America, Pittsburgh, Pa.

[21] Appl. No.: 752,922

[22] Filed: Jul. 8, 1985

Related U.S. Application Data

[63] Continuation of Ser. No. 187,843, filed as PCT FR79/00020 on Mar. 6, 1971, published as WO79/00725 on Oct. 4, 1979, now Pat. No. 4,534,266.

[30] Foreign Application Priority Data

Mar. 8, 1978 [FR] France ..... 78 07538

[51] Int. Cl.[5] ..... B22D 19/02; F41H 5/04

[52] U.S. Cl. ..... 89/36.02; 164/108; 164/110; 428/545; 428/911

[58] Field of Search ..... 164/108, 110, 112, 98, 164/111, 231, 333, 334, 370, 91, 97, 30, 32, 9, 11; 428/545, 593, 619, 686, 911; 89/36.02

[56] References Cited

U.S. PATENT DOCUMENTS

| | | | |
|---|---|---|---|
| 1,815,187 | 7/1931 | Coles | 428/593 |
| 3,324,768 | 6/1967 | Eichelberger | 89/36.02 |
| 3,567,407 | 3/1971 | Yoblin | 428/593 |
| 3,573,150 | 3/1971 | Broutman . | |
| 3,705,558 | 12/1972 | McDougal | 89/36.02 |
| 3,826,172 | 1/1974 | Dawson | 89/36.02 |
| 3,970,136 | 7/1976 | Cannell | 164/108 |
| 4,061,815 | 12/1977 | Poole . | |
| 4,197,341 | 4/1980 | Rule | 428/593 |
| 4,588,015 | 5/1986 | Liebermann | 164/463 |

FOREIGN PATENT DOCUMENTS

| | | |
|---|---|---|
| 719151 | 3/1942 | Fed. Rep. of Germany . |
| 1142689 | 2/1969 | United Kingdom . |

OTHER PUBLICATIONS

Webster'Third New International Dictionary, copyright 1981, The Definition of "Cast".

*Primary Examiner*—Richard K. Seidel
*Attorney, Agent, or Firm*—Daniel A. Sullivan, Jr.; Douglas P. Mueller

[57] ABSTRACT

The invention relates to the manufacture of composite metal armour plating comprising ceramic inserts (42) regularly disposed through the thickness and giving reliable, reproducible ballistic efficiency.

The ceramic inserts are positioned at regular intervals by disposing them in enveloping shells comprising male and female portions fitting into one another in order to bring about relative predetermined positioning and leave gaps into which the actual casting metal can flow during casting.

8 Claims, 3 Drawing Sheets

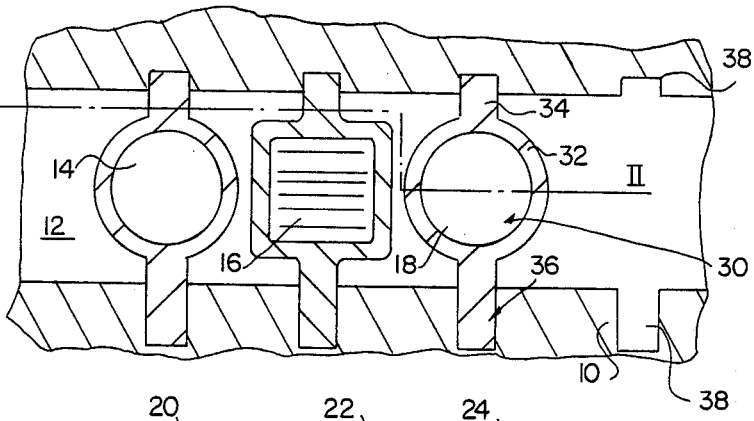
FIG. 1
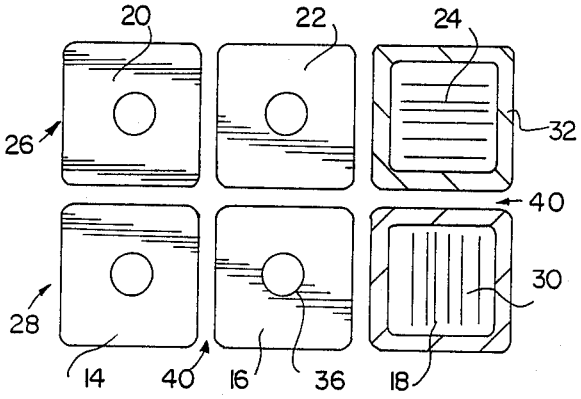
FIG. 2
FIG. 4
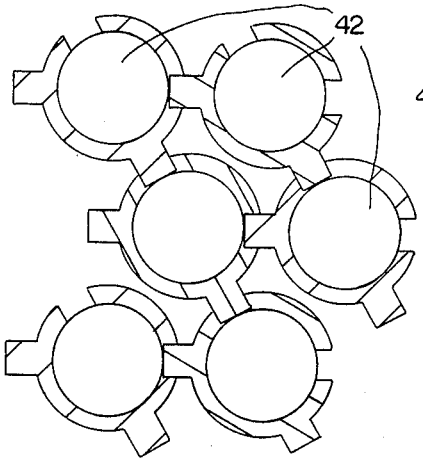
FIG. 3
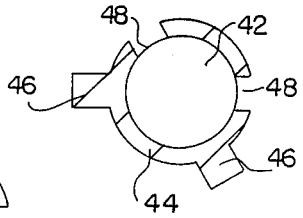

MOLDED COMPOSITE ARMOR

This is a continuation of co-pending application Ser. No. 187,843 filed as PCT FR 79/00020 on Mar. 6, 1971, published as WO 79/00725 on Oct. 4, 1979, now U.S. Pat. No. 4,534,266.

The invention relates to a method of manufacturing composite metal components, inter alia cast armor plating, comprising ceramic inserts embedded in the component when the component is cast. The invention also relates to armor plating made by the method.

In some known methods of this kind, the ceramic inserts are first mixed with the liquid metal and the assembly is placed in a mold where the metal solidifies and holds the inserts in random positions, i.e. resulting from the position of each insert at the moment when the surrounding metal solidifies.

The inserts, owing to their random positions, do not give reliable, reproducible ballistic efficiency. To obviate this unreliability, the armor is made thicker. The weight of the armor is a serious handicap for mobile devices, inter alia tanks, and the object of the invention is to construct armor plating having increased, reliable ballistic efficiency.

U.S. Pat. No. 3,705,558 discloses light-alloy armor comprising a layer of inserts made up of a pyramid of ceramic balls. This layer, which is placed at the center of the armor, is a discontinuity which reduces the mechanical strength. The ceramic balls are in contact with one another and leave very small gaps for the liquid metal. The supports holding the balls in the mold may bend as a result of expansion caused by the liquid metal and softening after heating.

The method according to the invention aims to obviate these disadvantages and is characterized in that the ceramic inserts have positioning protuberances and are disposed and positioned by means of the protuberances in regular manner in the mold in a predetermined network to ensure ballistic efficiency and leave gaps between them for the liquid metal, and the liquid metal is poured into the mold so as to fill the gaps and embed the inserts, which are anchored and finely positioned in the armor plating when the metal solidifies.

The method according to the invention ensures predetermined positioning, thus advantageously securing the ceramic inserts in space at intervals which ensure the maximum ballistic efficiency, allowing for the direction in which the projectile comes.

The invention also relates to a method of constructing composite armor in which a metal shell is cast around each insert to embed it and the liquid metal forming the armor is cast without appreciably melting the shells.

According to one feature of the invention the ceramic inserts which can be spheres or cylinders or ovoid or prismatic, are embedded in a shell forming an individual metal cover having male and female portions for fitting the embedded inserts in one another so as to hold them in fixed relative positions.

The individual embedment of the inserts is made in a mold enabling the ceramic insert to be positioned in an invariable central place. The liquid metal is poured into the space between the mold and ceramic, thus embedding the insert and forming a shell having projecting tenons and hollow portions used for subsequent relative positioning in the armor proper. The inserts in their shells are prepared by eliminating any projections used for casting and any traces of joins which could interfere with the subsequent assembling of the inserts.

The cast metal armor plating is manufactured by placing the joined-together inserts in the mold and resting them on the mold walls in order to secure them when the mold is closed, thus preventing any displacement when the actual armor is cast.

The shell can be made of the same or different metal from the metal forming the armor, and the armor is cast under conditions chosen to prevent any melting of the shell surrounding the insert. It may be advantageous to heat the coated inserts before casting the metal armor, to prevent any surface reaction which may adversely affect the compactness of the armor. The embedment of the inserts permits an increased ballistic efficiency of the armor. The ceramics used are chosen, for their ballistic properties and can e.g. be of the kind described in the previously-mentioned patent. Sintered aluminum oxide based inserts are of use.

In armor plating, inter alia thin plating, the inserts can be disposed in a single layer, aligned in a number of parallel rows, the spaces between the inserts in a single row and the spaces between the rows being sufficient to cast the liquid metal and properly fill the mold.

The inner mold surface can have positioning means, e.g. female portions, adapted to receive and engage the tenons of the inserts in order to obtain proper positioning. If the armor has a number of layers of inserts, it is advantageous to dispose them in staggered layers and/or in imbricated layers. The assembly formed by the inserts can constitute a three-dimensional structure disposed in regular manner in the armor. Spherical inserts can give spatial symmetry but are difficult to make. Cylindrical inserts preferably have a height equal to their diameter in order to preserve some symmetry, and the axes of each pair of adjacent inserts are disposed perpendicularly in order to prevent any narrow passage between two adjacent and hollow portions used for subsequent relative positioning surfaces.

The inserts are placed in the mold or in the network, either by hand or automatically in the case of mass production.

Other advantages and features will be clear from the following description of a number of embodiments of the invention given by way of non-limitative examples and shown in the accompanying drawings in which :

FIG. 1 is a diagrammatic view in section of a mold for casting armor according to the invention:

FIG. 2 is a section along the broken line 11—11 in FIG. 1 showing how the inserts are disposed:

FIG. 3 is a diagrammatic section through an insert according to a variation of the invention, and FIG. 4 shows how inserts according to FIG. 3 are fitted together.

In the drawings, a mold 10 for casting a plate, inter alia metal armor, bounds a chamber 12 adapted to be filled by metal liquid during casting. The mold and the method of casting are conventional and appropriate to the nature of the cast component, and need not be described.

Inserts are disposed in mold 10 and only six inserts 14, 16, 18, 20, 22, 24, grouped in two parallel rows 26 and 28, are shown in the drawings. Inserts 14–24 are all identical and each have a cylindrical ceramic core 30 embedded in a metal shell 32. Shell 32 has two diametrically opposite projections or tenons 34, 46. The ceramic inserts are manufactured and embedded beforehand by methods well known to the experts, e.g. they are embedded by molding. The inner walls of mold 10 have pairs of facing blind holes 38 receiving the tenons 36 of inserts 14–24. The parts can be interlocked by hand or semi-automatically. It is easy to see that, after mold 10 has been closed, inserts 14–24 are positioned and held in the mold in a network determined by the position of holes 38. Spaces 40 are left between inserts 14–24 and are sufficiently large for the liquid metal to flow through them when mold 10 is filled. In the example illustrated in FIGS. 1 and 2, the height of the cylindrical inserts 14–24 is equal to their diameter and they are disposed regularly in a grid. The axes of each pair of adjacent inserts, e.g. 14, 16 or 14, 20, are perpendicular in order to facilitate the flow of liquid metal between the inserts.

The metal for embedding the inserts can be the same as or different from the metal used for the armor, and the whole is designed so as to prevent shells 32 melting when the armor is cast. Consequently, inserts 14–24 remain in the correct position. After the plate has been taken out of the mold, the projecting parts of tenons 36 can be removed by any appropriate means.

Of course, inserts 14–24 can have a different shape, e.g. prismatic or spherical, or some inserts can have a shape and/or size different from the others, in which case the positioning network will be adapted accordingly. The inserts can be relatively positioned by connections between them, thus simplifying the molds.

The ballistic efficiency is increased by a multi-layer structure, in which case connections are provided between the inserts to form a cross-linked structure which can be inserted into mold 10.

FIG. 4 by way of example, illustrates a three-layer structure comprising an assembly of spherical inserts 42 of the kind shown in FIG. 3. Each insert 42 is embedded in a shell 44 having tenons 46 and diametrically opposite mortices 48 which can be fitted together in a predetermined spatial network in one or more layers. Advantageously, the inserts 42 are disposed in staggered rows and/or are made to partially overlap, by disposing the tenon/mortice pairs 46, 48 at an acute angle as illustrated in the drawings. The resulting cellular structure leaves spaces for liquid metal to flow between inserts 42 and, after the metal has solidified, the inserts are incorporated in the armor in well-defined positions.

Of course, the inserts can be joined by a different method, inter alia by bars which are received in associated orifices in the inserts or by cages which hold the inserts. The inserts are not necessarily embedded, even though embedded inserts are the preferred embodiment of the invention. The metal forming the armor can be steel or a light alloy or any other appropriate metal or alloy.

I claim:

1. A composite component useful in formation of armor, comprising:

a core member exhibiting properties for resisting a projectile;

a cast metal shell for said core member;

said core member being embedded in said cast metal shell, said cast metal shell forming an individual metal cover surrounding the core.

2. The component of claim 1, wherein the shell comprises means for cooperating with adjacent composite components in a mold for forming armor so that the components are maintained in fixed relative positions.

3. The component of claim 2, wherein the means for cooperating provides a space between components which is sufficient so that molten metal can flow in the spaces between the components.

4. The component of claim 3, wherein the means for cooperating is provided by a mortice and tenon on the shell.

5. The component of claim 1, wherein the metal shell is formed of a light metal.

6. The component of claim 1, wherein the core member is formed of a ceramic.

7. The component of claim 6, wherein the core member is formed of aluminum oxide.

8. The component of claim 1, wherein the core member is cylindrical.

* * * * *